US007546075B2

(12) United States Patent
Hirai et al.

(10) Patent No.: US 7,546,075 B2
(45) Date of Patent: Jun. 9, 2009

(54) IMAGE FORMING APPARATUS FEATURING A MULTILAYER MEMBER WITH A ROUGHENED LAYER SURFACE TO IRREGULARLY REFLECT INCIDENT LIGHT AND METHOD FOR MAKING THE MULTILAYER MEMBER

(75) Inventors: Masahide Hirai, Numazu (JP); Noriaki Egawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 351 days.

(21) Appl. No.: 11/312,835

(22) Filed: Dec. 21, 2005

(65) Prior Publication Data

US 2006/0159494 A1 Jul. 20, 2006

(30) Foreign Application Priority Data

Dec. 27, 2004 (JP) ..... 2004-375465
Oct. 11, 2005 (JP) ..... 2005-295936
Oct. 28, 2005 (JP) ..... 2005-314704

(51) Int. Cl.
*G03G 15/01* (2006.01)
*G03G 15/00* (2006.01)

(52) U.S. Cl. ..... 399/303; 399/74; 399/302

(58) Field of Classification Search ..... 399/302, 399/303, 162, 74
See application file for complete search history.

(56) References Cited

U.S. PATENT DOCUMENTS 4,618,552 A 10/1986 Tanaka et al. ..... 430/60
5,944,930 A 8/1999 Takeuchi et al. ..... 156/218
6,042,985 A 3/2000 Matsuda et al. ..... 430/126
6,381,428 B1 4/2002 Yamamoto et al. ..... 399/116
6,830,857 B2 12/2004 Kabata et al. ..... 430/56
6,879,799 B2 4/2005 Nohsho et al. ..... 399/267
6,962,637 B2 11/2005 Takeuchi et al. ..... 156/85
7,078,143 B2 7/2006 Hashimoto et al. ..... 430/131
2004/0136017 A1* 7/2004 Motoyama et al. ..... 358/1.9

FOREIGN PATENT DOCUMENTS

JP 7-205274 8/1995
JP 10-39646 2/1998
JP 11-65329 3/1999
JP 11-316506 A 11/1999
JP 2001-134042 A 5/2001
JP 3441860 6/2003
JP 2003-228198 8/2003
JP 2003-270830 A 9/2003
JP 2003-295557 10/2003
JP 2004-29534 1/2004
JP 2004-109249 A 4/2004
JP 2004-226491 8/2004

OTHER PUBLICATIONS

Japanese Office Action dated Nov. 4, 2008 in Japanese Application No. 2005-314704 and English-language translation thereof.

* cited by examiner

*Primary Examiner*—David M Gray
*Assistant Examiner*—Joseph S Wong
(74) *Attorney, Agent, or Firm*—Fitzpatrick, Cella, Harper & Scinto

(57) ABSTRACT

A belt includes a surface layer and an underlayer. An interface between the surface layer and the underlayer is roughened to irregularly reflect incident light.

20 Claims, 9 Drawing Sheets

IMAGE FORMING APPARATUS FEATURING A MULTILAYER MEMBER WITH A ROUGHENED LAYER SURFACE TO IRREGULARLY REFLECT INCIDENT LIGHT AND METHOD FOR MAKING THE MULTILAYER MEMBER

BACKGROUND OF THE INVENTION

1. Field of the Invention

The present invention relates to an image forming apparatus such as a laser beam printer or a copying machine, and particularly, to a belt applicable to the apparatus.

2. Description of the Related Art

Color image forming apparatuses are now in practical use in which toner images formed on a plurality of photoconductive drums are superimposed. One type of color image forming apparatus is a tandem direct-transfer multicolor image forming apparatus that forms a multicolor image by directly transferring toner images onto a recording material conveyed by an electrostatic transportation belt (hereinafter, the belt will be abbreviated as an "ETB", and the apparatus will be referred to as an "ETB system"). In the ETB system, a plurality of photoconductive drums are individually charged by charging means, and electrostatic latent images are respectively formed on the photoconductive drums by exposure means. Then, toner negatively charged by friction charging of developing means is applied onto the electrostatic latent images on the photoconductive drums to form toner images, and the toner images are directly transferred onto a recording material transported by the ETB. The recording material having the toner images is delivered from the ETB to a fixing device, and the toner images are fixed on the recording material. Through this procedure, a full-color toner image is formed on the recording material.

Another type of color image forming apparatus is an intermediate-transfer multicolor image forming apparatus that forms a multicolor image by primarily transferring toner from photoconductive drums onto an intermediate transfer belt (hereinafter abbreviated as an "ITB", as required), and then secondarily transferring the toner onto a recording material (hereinafter, the apparatus will be referred to as an "ITB system"). In the ITB system, the ITB is in contact with the photoconductive drums at primary transfer positions. Toner images formed on the photoconductive drums are transferred onto the ITB (primary transfer), and are then transferred from the ITB onto a recording material at a secondary transfer position (secondary transfer). The ETB and the ITB are sometimes generically and simply referred to as a transfer belt or belt.

In these image forming apparatuses, the density and position of toner on the transfer belt are detected in order to achieve high-color reproducibility and high-definition images. Detection of the density and position is typically performed with an optical sensor because of its low cost and high accuracy. A toner patch is formed on the transfer belt, and the presence and density of toner is detected by using the toner patch, that is, on the basis of the difference in reflectance between a toner portion and a portion having no toner. The position and density of the toner are adjusted according to a detection result.

A reflective optical sensor is often used as the optical sensor. In the reflective optical sensor, the intensity of light, which is incident on the transfer belt at a fixed angle (e.g., 30°) and is regularly reflected by the transfer belt, is monitored by a detector such as a phototransistor. The light is emitted from an inexpensive and long-life light emitting diode serving as a light source, and has a wavelength within a range over the visible region and the near-infrared region, that is, within a range of 400 to 1000 nm.

The transfer belt is required to have various characteristics, for example, reflectance needed to detect the density and position of toner, wear resistance and excoriation resistance needed to prevent the surface of the belt from being worn or roughened by friction with toner, carrier, a cleaning blade, and a recording material, and a sliding characteristic for preventing stick slip with respect to cleaning blades and the photoconductive drums.

In order to ensure these characteristics, it is known to form a multilayer structure by coating the surface of the transfer belt. This method realizes a high-performance inexpensive transfer belt.

However, depending on the layer structure, there is a need to prevent an adverse effect of light interference between a plurality of layers. For example, when the density and displacement of toner provided on a multilayer belt or image bearing member are detected by an optical sensor, interference reduces detection accuracy.

SUMMARY OF THE INVENTION

The present invention avoids the influence of interference of light reflected by a multilayer belt or an image bearing member, and provides a belt or member that prevents the accuracy of density and position detection from decreasing.

An image forming apparatus according to a first aspect of the present invention includes a first image bearing member for bearing a toner image, a second image bearing member onto which the toner image is transferred from the first image bearing member, a light emitting member for emitting light onto the second image bearing member, and a light receiving member for receiving reflected light from the second image bearing member. The second image bearing member includes a base layer and a surface layer provided on the base layer. The surface layer transmits the light emitted from the light emitting member. The surface roughness Ra expressed in micrometers (μm) of a surface side of the base layer facing the surface layer is 0.1 μm or more.

An image forming apparatus according to a second aspect of the present invention includes a belt including a base layer and a surface layer provided on the base layer, a light emitting member for emitting light onto the belt, and a light receiving member for receiving reflected light from the belt. The surface layer transmits the light emitted from the light emitting member. The surface roughness Ra of a surface side of the base layer facing the surface layer is 0.1 μm or more.

An image forming apparatus according to a third aspect of the present invention includes a belt including a base layer and a surface layer provided on the base layer, a light emitting member for emitting light onto the belt, and a light receiving member for receiving reflected light from the belt. The surface layer transmits the light emitted from the light emitting member, and the belt reflects the light emitted from the light emitting member at a surface side of the belt and a surface side of the base layer facing the surface layer. The ratio of the intensity of an irregularly reflected light component, of the reflected light from the belt, to the intensity of a regularly reflected light component is higher at the surface side of the base layer than at the surface side of the belt.

A belt according to a fourth aspect of the present invention is applicable to an image forming apparatus, and includes a base layer, and a surface layer provided on the base layer. The surface layer transmits light so that the light is reflected by a surface side of the surface layer provided on a surface side of the belt and by a surface side of the base layer facing the surface layer. The surface roughness Ra of the surface side of the base layer is 0.1 μm or more.

A belt according to a fifth aspect of the present invention is applicable to an image forming apparatus, and includes a base layer, and a surface layer provided on the base layer. The surface layer transmits light so that the light is reflected by a surface side of the surface layer provided on a surface side of the belt and by a surface side of the base layer facing the surface layer. The ratio of the intensity of an irregularly reflected light component, of reflected light from the belt, to a regularly reflected light component is higher at the surface side of the base layer than at the surface side of the surface layer.

Further features of the present invention will become apparent from the following description of exemplary embodiments with reference to the attached drawings.

DESCRIPTION OF THE EMBODIMENTS

Image forming apparatuses according to the preferred embodiments of the present invention will be described in detail below with reference to the drawings.

First Embodiment

Color Stations

Figure 5:
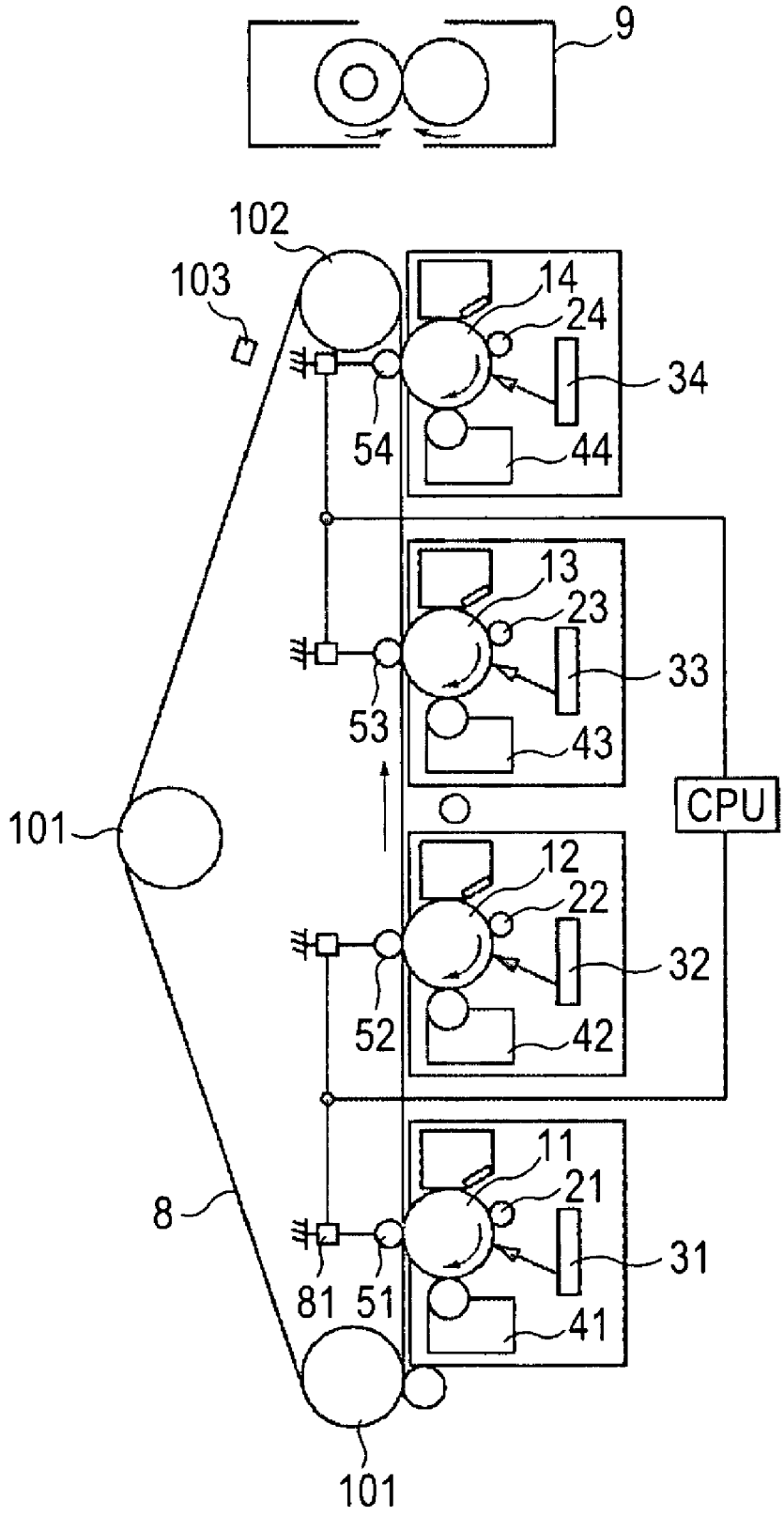
FIG. 5 is a schematic sectional view of an image forming apparatus according to the first embodiment.

A description will be given of a tandem direct-transfer multicolor image forming apparatus (ETB system) according to a first embodiment of the present invention. FIG. 5 is a schematic sectional view of a color image forming apparatus (an image forming section in a laser printer or a copying machine) using an electrophotographic process.

In the image forming apparatus, four independent color stations corresponding to yellow (Y), magenta (M), cyan (C), and black (K) colors are vertically arranged in line, and each of the color stations includes an electrophotographic photoconductor, a developing device, and a cleaning device. In the image forming apparatus, a full-color image is obtained by transferring an image onto a recording material drawn on an electrostatic transportation belt in each color station while transporting the recording material.

Drum-shaped rotary electrophotographic photoconductors (hereinafter referred to as photoconductive drums) 11 to 14 are negatively charged organic photoconductors having a diameter of 30 mm, and are repetitively used as image bearing members. The photoconductive drums 11 to 14 are rotated at a predetermined peripheral velocity v1 of 181 mm/s (process speed) in the clockwise direction shown by the arrows in FIG. 5.

During rotation, the photoconductive drums 11 to 14 are uniformly charged at a predetermined polarity and a predetermined potential by primary charging rollers 21 to 24, and are then subjected to image exposure by image exposure means 31 to 34 (for example, each including a laser diode, a polygonal scanner, and a lens unit), so that electrostatic latent images corresponding to color component images (yellow, magenta, cyan, and black component images) that constitute a target color image are formed on the photoconductive drums 11 to 14.

The above-described primary charging is performed by a DC contact method in a state in which a DC voltage of 1.2 kV is applied to the primary charging rollers 21 to 24 having an actual resistance of $1\times10^6$ Ω, and the primary charging rollers 21 to 24 are in contact with the photoconductive drums 11 to 14 with a total pressure of 9.8 N. As a result of this charging, the surfaces of the photoconductive drums 11 to 14 are charged at −600 V. Further, the image exposure means 31 to 34 irradiate the photoconductive drums 11 to 14 with a laser beam modulated according to image signals, thereby forming electrostatic latent images thereon.

Subsequently, the electrostatic latent images are developed by developing devices 41 to 44 (yellow, magenta, cyan, and black) respectively provided in the color stations. The developing devices 41 to 44 are disposed to face the corresponding photoconductive drums 11 to 14. The developing devices 41 to 44 respectively contain yellow, magenta, cyan, and black nonmagnetic toners that do not contain magnetic materials, and adopt a monocomponent contact developing method.

In each of the developing devices 41 to 44, development is performed by coating a development sleeve, which is disposed opposed to the corresponding photoconductive drum, with toner by a developing blade, and applying approximately −500 V to the development sleeve that is being rotated at the same velocity as that of the photoconductive drums 11 to 14.

ETB Unit

An ETB 8 is tightly stretched by tension rollers 101 and a driving roller 102, and is rotated by the driving roller 102 at a peripheral velocity v2 of 185 mm/s in the direction shown by the arrow in FIG. 5. The ETB 8 is a two-layer resin belt including a base layer made of polyvinylidene fluoride (PVDF) and having a resistance adjusted to $1\times10^6$ to $1\times10^{11}$ Ω.cm. Ribs are stuck on both back side edges of the ETB 8 to prevent meandering and offset. The thickness d1 of the base layer is set to be larger than 50 μm and smaller than 150 μm because breakage frequently occurs when the thickness d1 is smaller than or equal to 50 μm and setting of the belt adversely affects images when the thickness d1 is larger than or equal to 150 μm. Details of the two-layer resin belt, including details of a surface layer (a layer forming an outer surface of the ETB 8) will be described below.

Transfer rollers 51 to 54 serving as transfer members are made of a mixture of epichlorohydrin rubber and nitrile butadiene rubber (NBR), which has a volume resistivity adjusted to $1\times10^7$ Ω.cm and to which high pressure can be applied. The transfer rollers 51 to 54 are in contact with nips between the photoconductive drums 11 to 14, respectively, with the ETB 8 therebetween with a total pressure of 2.94 N from the back side of the ETB 8.

A recording material is supplied from a recording-material storage cassette (not shown), passes through a transfer entrance guide, and is drawn onto the ETB 8 between a drawing roller and the ETB 8. In a transfer region of the first color transfer station, a toner image formed on the photoconductive drum 11 is transferred onto the recording material drawn on the ETB 8. A bias to be applied to the transfer roller 51 is determined on the basis of the impedances of the ETB 8 and the recording material that are calculated from the current passing through the drawing roller during the passage of the recording material. When printing on one side of the recording material is performed in a normal condition, a DC bias of approximately +1.5 kV is applied from a high-voltage power supply 81 to the color stations.

While the recording material passes through the color stations, toner images of different colors are transferred from the photoconductive drums 11 to 14 onto the recording material, thereby forming a full-color image thereon. After all color images are transferred, the recording material is separated from the rear end of the ETB 8 because of curvature, and the full-color image is fixed by a fixing device 9. Then, the recording material is ejected out of the image forming apparatus via a conveyance unit, and a final print is thereby obtained.

The ETB 8 also functions as an image bearing member on which a so-called toner patch is directly transferred so that density control can be executed with reference to the toner patch.

Density Sensor

A density sensor 103 is used to detect the density of toner on the ETB 8 in order to achieve high color reproducibility and high-definition image output. The density sensor 103 is an optical sensor that detects the level of reflected light with respect to incident light.

Figure 4:
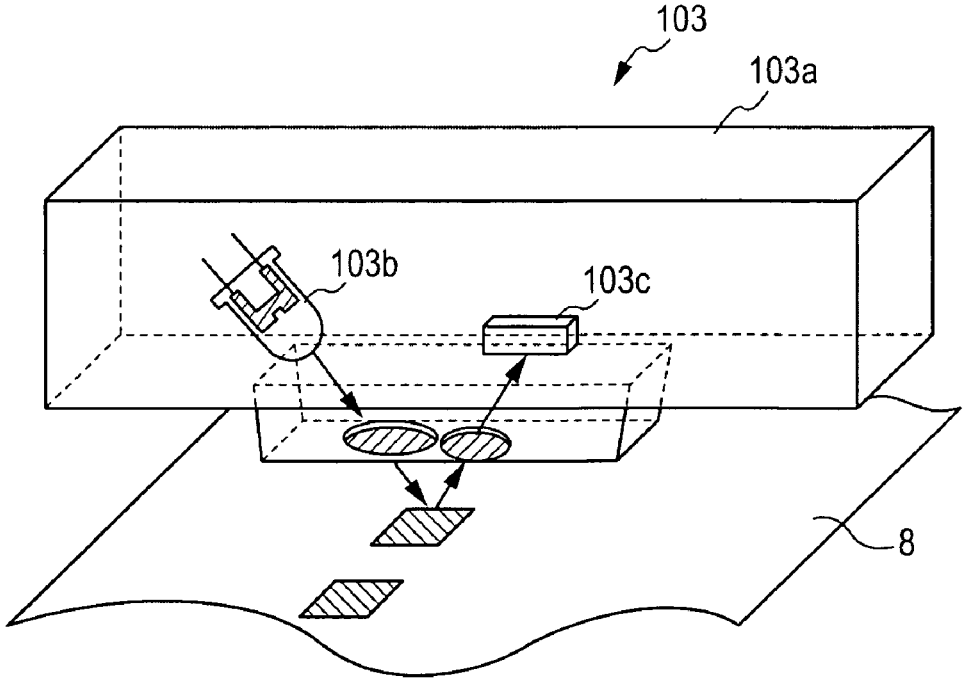
FIG. 4 is an explanatory view of a density sensor in the first embodiment.

The density sensor 103 detects a toner patch formed on the ETB 8, and checks the presence of toner and the toner density on the basis of the difference in reflectance between a portion of the ETB 8 having a toner patch and a portion having no toner patch. As shown in FIG. 4, the density sensor 103 includes a light source and a detector disposed in a black container 103*a* that absorbs light in order to avoid undesirable influence of reflected ambient light.

The light source is a light emitting diode 103*b* that is inexpensive and has a long life, and emits light having a wavelength of 900 nm within the range of the visible region to the near-infrared region. The incident angle and the reflection angle are both set at 30°. The detector is a phototransistor 103*c* (light receiving member) disposed at a position such as to receive regularly reflected light of the light from the light emitting diode 103*b*, and functions as a detector for detecting the intensity of the reflected light.

The result of detection by the density sensor 103 is reflected in, for example, the developing bias and the latent-image potential, and contributes to formation of the next toner image.

Structure of Two-Layer Belt

As described above, the ETB 8 used in the first embodiment has a two-layer structure in which a front coat layer (acrylic coat layer) having a thickness of 1.0 μm is provided on a base layer made of PVDF and having a thickness of approximately 100 μm. The base layer serves as an underlayer disposed directly under the surface layer.

PVDF is sometimes used as the material of a belt because of its production and cost advantages. However, since a general-purpose engineering plastic, such as PVDF, has a low Young's modulus serving as an index of the elastic modulus, when relaxation and generation of tension applied to the ETB 8 are repeated, the degree of expansion and contraction of the ETB 8 increases. Every time the ETB 8 rotates in the belt unit, it is repetitively wound around the tension rollers 101 and the driving roller 102. In such a state in which the ETB 8 is wound around these rollers, the perimeter of the inner surface of the ETB 8 is different from the perimeter of the outer surface because of its thickness of the ETB 8, that is, the outer perimeter increases and the inner perimeter decreases. With winding, the ETB 8 is repetitively expanded and contracted, and suffers fatigue. As a result, a tension line is formed on the ETB 8 in the feeding direction of the recording material. In order to overcome the above-described disadvantage, the surface of the PVDF belt is sometimes coated. In the first embodiment, acrylic resin is used as the material of the surface layer. Acrylic resin can overcome the above-described disadvantage of the single-layer PVDF belt because its Young's modulus and hardness are high.

The thickness d2 of the acrylic surface layer is preferably set within the range of 0.1 to 5.0 μm. The front coat layer may be worn and lost with use when the thickness d2 is smaller than 0.1 μm, and in contrast, may crack when the thickness d2 is larger than 5.0 μm.

When images were formed on sixty thousand recording sheets by using a single-layer PVDF belt, a tension line was formed on the ETB 8 and resultingly was observed on the images. In contrast, even when printing on more than three-hundred thousand recording sheets was performed by using a two-layer belt having a surface layer of acrylic resin, a tension line was not observed on the images. Accordingly, while the life of the ETB unit was sixty thousand prints when the PVDF single-layer belt is used, it could be increased to more than three-hundred thousand prints when the two-layer belt is used. That is, it was confirmed that the life could be increased to more than five times the life of the unit using the single-layer PVDF belt.

Specifically, the PVDF belt having the acrylic surface layer was produced according to the following method. Particles of 10% by mass of Ketjenblack (EC600 from Lion Corporation) were mixed in PVDF resin (from Kureha Chemical Industry Co., Ltd.), and the mixture was kneaded to form a composition. The composition was then shaped into a sheet having a thickness of 100 μm, and the sheet was shaped like a cylinder, thereby forming a base layer of a transfer belt.

The base layer of the transfer belt may be formed by any method as long as both ends of the sheet are joined so that a step at a joint does not adversely affect the application and so that sufficient strength can be ensured. For example, a plastic sheet may be shaped like a cylinder by welding only both ends of the sheet, as disclosed in Japanese Patent Laid-Open No. 7-205274. Alternatively, a plastic sheet may be wound between two cylindrical dies having different thermal expansion coefficients, and may be entirely heated together with the dies, as disclosed in Japanese Patent No. 3441860. In the first embodiment of the present invention, the base layer of the transfer belt was obtained by using the method of Japanese Patent No. 3441860.

Further, a surface layer having a thickness of approximately 1 μm was formed by coating the following surface-layer coating liquid on the surface of the base layer by slit coating and irradiating the liquid with ultraviolet rays. The surface-layer coating liquid was prepared to contain 100 parts of an ultraviolet-curing acrylic resin solution (content of 50 weight percent, "DeSolite" from JSR Corporation), 25 parts of a zinc-antimonate particle dispersed solution (content of 20 weight percent, "CELNAX" from Nissan Chemical Industries, Ltd.), and 75 parts of methyl isobutyl ketone.

On the other hand, when the surface layer of the two-layer belt is transparent, there are variations in detection accuracy.

The belt is generally produced so that the thickness of the surface layer is uniform. However, the production accuracy is limited, and it is quite difficult to ensure nano-order accuracy. Therefore, the thickness of the surface layer slightly varies.

Light has a wavelength within a range of nano orders. Interference between light reflected by the surface side of the belt and light reflected by an interface between the surface layer and the base layer of the belt varies depending on the thickness of the surface layer. This is because the reflected light from the surface side and the reflected light from the interface are mutually strengthened or weakened by the variation in optical path length therebetween.

During density detection, the state of interference between the light reflected from the surface side of the belt and the light reflected between the surface layer and the base layer becomes nonuniform because of a variation in thickness of the surface layer. When reflected light from the surface side of the rotating belt is detected by the density sensor, the output from the density sensor varies because of slight variations in thickness of the surface layer, as described above.

Since the surface layer in the first embodiment is made of a highly transmissive acrylic resin, the variation of the interference remarkably appears.

Figure 2:
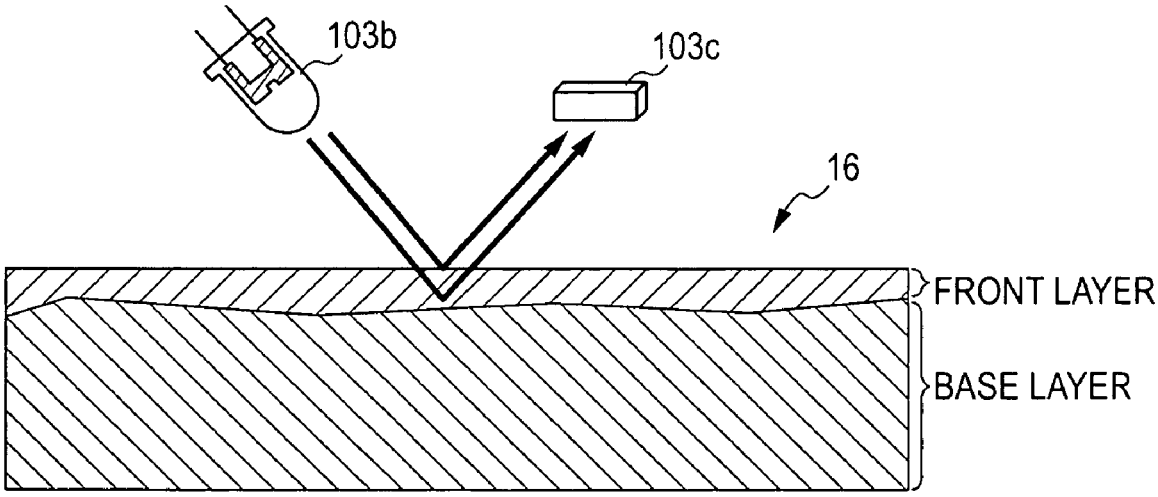
FIG. 2 is a conceptual view of a belt in which a base layer is not roughened.
Figure 9:
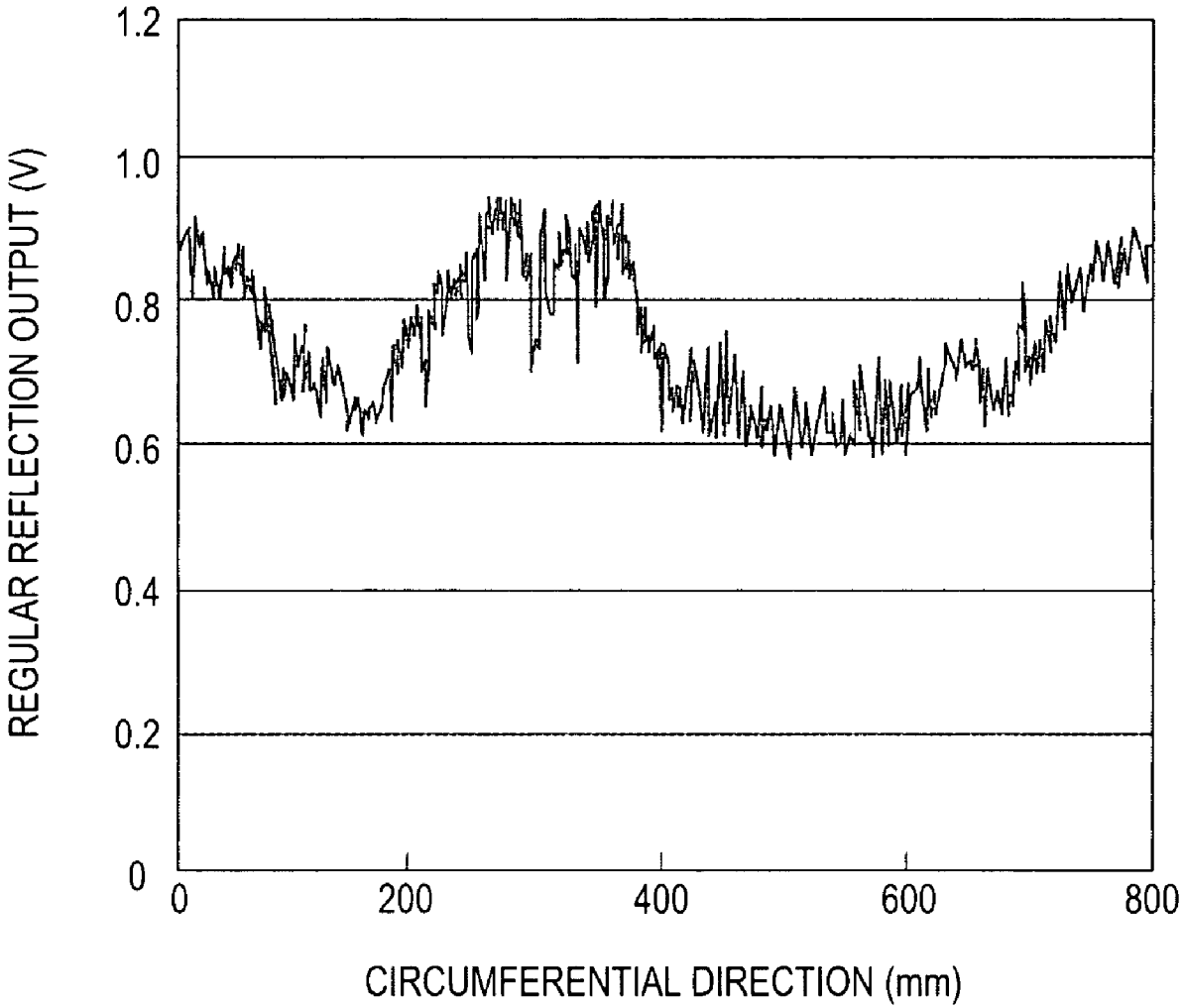
FIG. 9 is a graph showing the detection output from the density sensor for a two-layer belt which is not uniform in thickness and in which a base layer is not roughened.

FIG. 9 shows the waveform of an output from the density sensor obtained when a two-layer belt includes a surface layer having a nonuniform thickness and a base layer that is not roughened. The level of interference becomes nonuniform because of the variation in thickness of the surface layer, and the nonuniformity appears as variations of the waveform of the output from the detection sensor. FIG. 2 is a conceptual view showing light reflected by an ETB 16 in which a surface side of a base layer is not roughened. Light emitted from the light emitting diode 103*b* is regularly reflected by a surface side of the ETB 16 and an interface between a surface layer and the base layer, and both light beams reflected by the surface side and the interface enter the phototransistor 103*c*. Since the light beams reflected at the two positions have different optical path lengths, they are mutually strengthened or weakened when entering the phototransistor 103*c*, depending on the thickness of the surface layer.

Interference is caused because the surface layer is made of a transparent (highly transmissive) resin. Although the transmittance of the surface layer cannot be absolutely determined because it depends on, for example, the sensitivity of the phototransistor 103*c*, when it is 30% or more (9% in consideration of reflection), the problem of interference arises.

It is also conceivable to remove reflection of light by the base layer by making the surface layer of a material having low transmittance. In this case, however, the degree of flexibility in selecting the material is lowered, and it is also difficult to completely prevent light transmission, depending on the thickness of the surface layer.

In contrast, in the first embodiment, the surface roughness of the base layer in the two-layer ETB 8 is specified to irregularly reflect light between the surface layer and the base layer. This reduces a light component regularly reflected by the interference between the base layer and the surface layer, and prevents interference between light reflected by the surface side of the ETB 8 and light reflected by the interface during density detection. Consequently, it is possible to reduce baseline drift of reflected light and noise, and to achieve accurate density detection. By making the base layer rougher than the surface side of the ETB 8, the ratio of the intensity of irregularly reflected light to the intensity of regularly reflected light is higher at the surface side of the base layer facing the surface layer than at the surface side of the ETB 8.

More specifically, the surface roughness Ra of the base layer is set to be 0.1 μm or more to reduce regular reflection of light at the base layer and to thereby reduce interference with regular reflection at the surface layer. Moreover, the output of regularly reflected light during density detection is stabilized, and density detection is controlled precisely. Incidentally, it has been verified that the advantages of the first embodiment are provided even when the surface roughness Ra is 3.0 μm.

When the surface roughness Ra is too high, the effect of the front coat layer for avoiding a tension line is weakened. In a case in which the surface roughness Ra was 1.5 μm or less, a tension line was not observed even when recording on five million recording sheets was performed. In contrast, when the surface roughness Ra was 3.0 μm, a tension line was observed after recording on three hundred and fifty thousand recording sheets. Therefore, it is preferable that the surface roughness Ra be 1.5 μm or less.

The ETB 8 used in the first embodiment was shaped by roughening the surface side of a seamless belt (base layer belt) with a lapping sheet and then forming a front coat layer on the side.

The seamless belt (base layer belt) was tightly stretched by tension rollers (not shown), and the surface thereof was roughened while being rotated in contact with a lapping sheet. The lapping sheet used for this purpose is a lapping film having a particle size of 12 μm and manufactured by 3M Corporation.

In the first embodiment, the following belts having two different surface roughnesses were formed. Desired surface roughnesses were obtained by adjusting the lapping time.

The surface roughness Ra of a base layer was 0.05 to 0.06 μm (Rz=0.22 to 0.24 μm) before roughening. The base layer was roughened so that the surface roughness Ra was 0.07 μm to 0.09 μm (Rz=0.38 μm to 0.40 μm), and 0.10 μm to 0.15 μm (Rz=0.44 μm to 0.46 μm). The surface roughness Ra was measured with Surftest SJ-301 manufactured by Mitutoyo Corporation, and in a method based on JIS (Japanese Industrial Standards)-B-00601. The measurement length was 4.0 mm, and the cut off value was 0.8 mm.

The surface roughness Ra refers to the arithmetic mean roughness calculated in the following manner. A section of a reference length is sampled from the mean line on the roughness curve. When the X-axis indicates the direction of the mean line of the section, and the Y-axis indicates the longitudinal magnification, the surface roughness Ra is given by the following formula, and is expressed in micrometers (μm) when y=f(x):

$$Ra=1/L(\int^{L}_{0}|f(x)|dx)$$

Further, Rz represents the ten-point mean roughness calculated in the following manner and is expressed in micrometers (μm). A section of a reference length is sampled from the mean line on the roughness curve. The heights of five tallest peaks from the mean line of the sampled section and the depths of five lowest valleys from the mean line are measured in the direction of the longitudinal magnitude. The sum of the average of absolute values of the heights and the average of absolute values of the depths is expressed in micrometers (μm).

An acrylic coat layer serving as a surface layer was formed with a thickness of 1.0 μm by dipping on each of the belts roughened at different levels, thus forming a two-layer belt.

Figure 6:
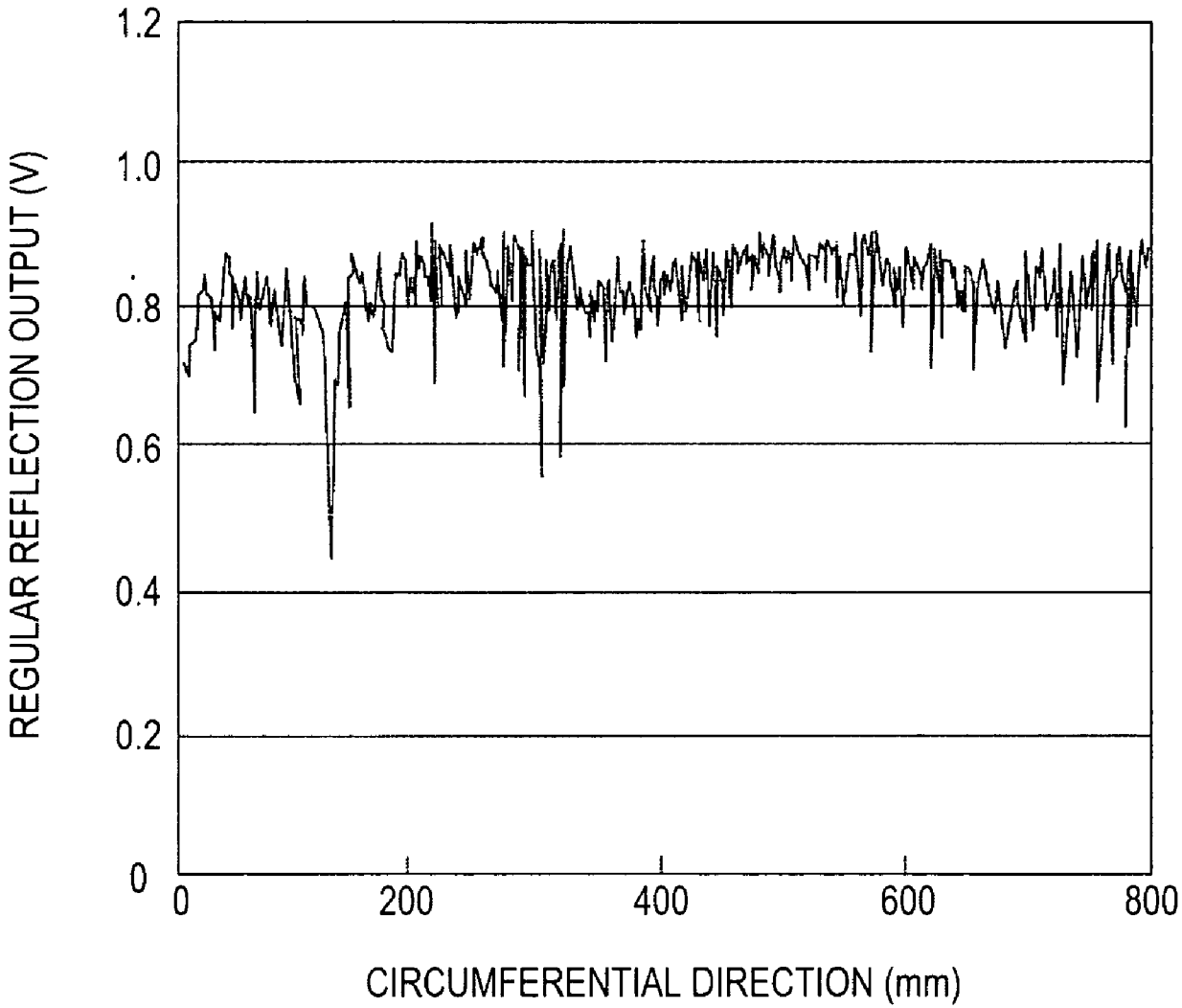
FIG. 6 is a graph showing the detection output from the density sensor for a known type of belt in which a base layer is not roughened.
Figure 7:
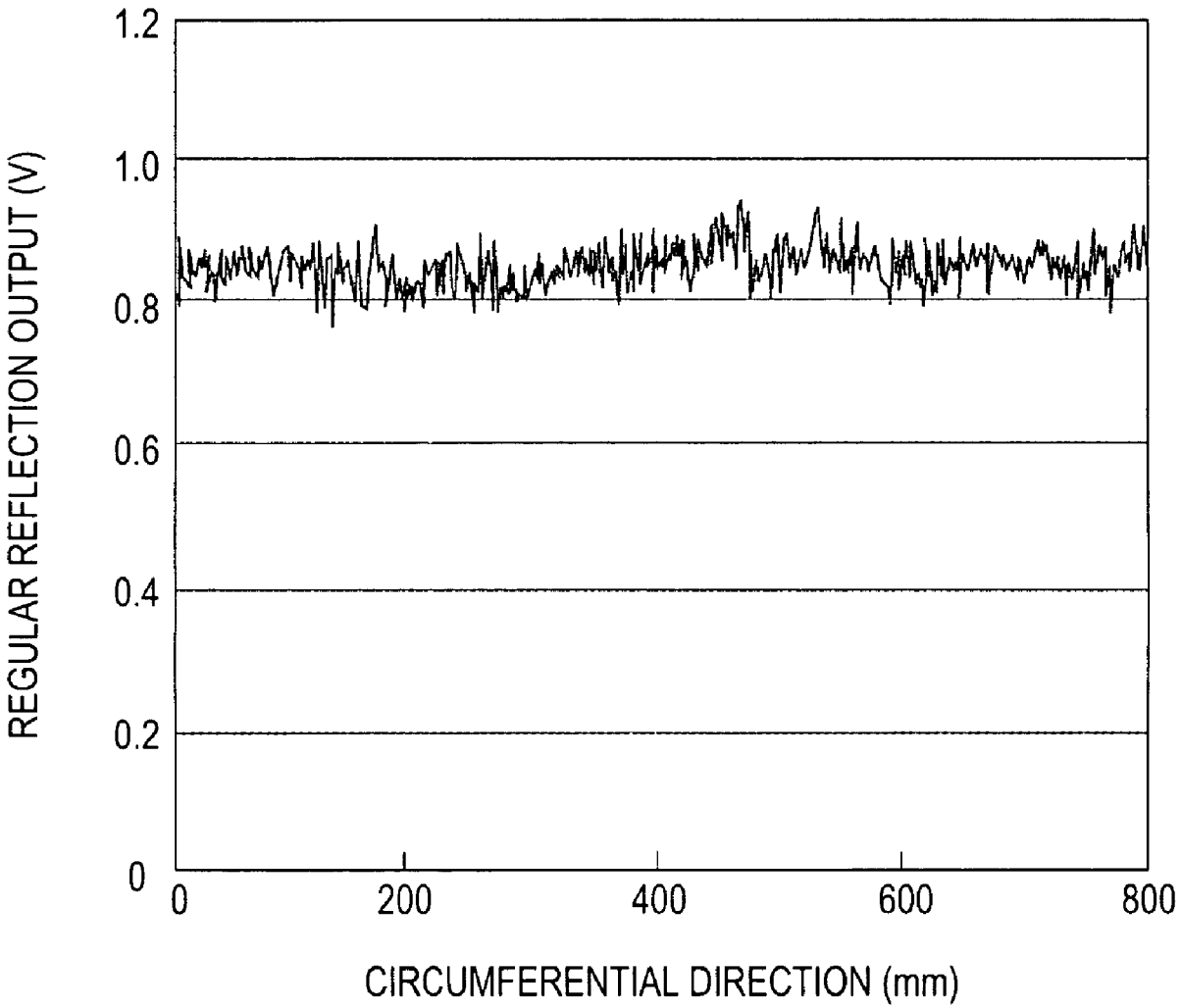
FIG. 7 is a graph showing the detection output from the density sensor for a belt in which a base layer is roughened according to the first embodiment.
Figure 8:
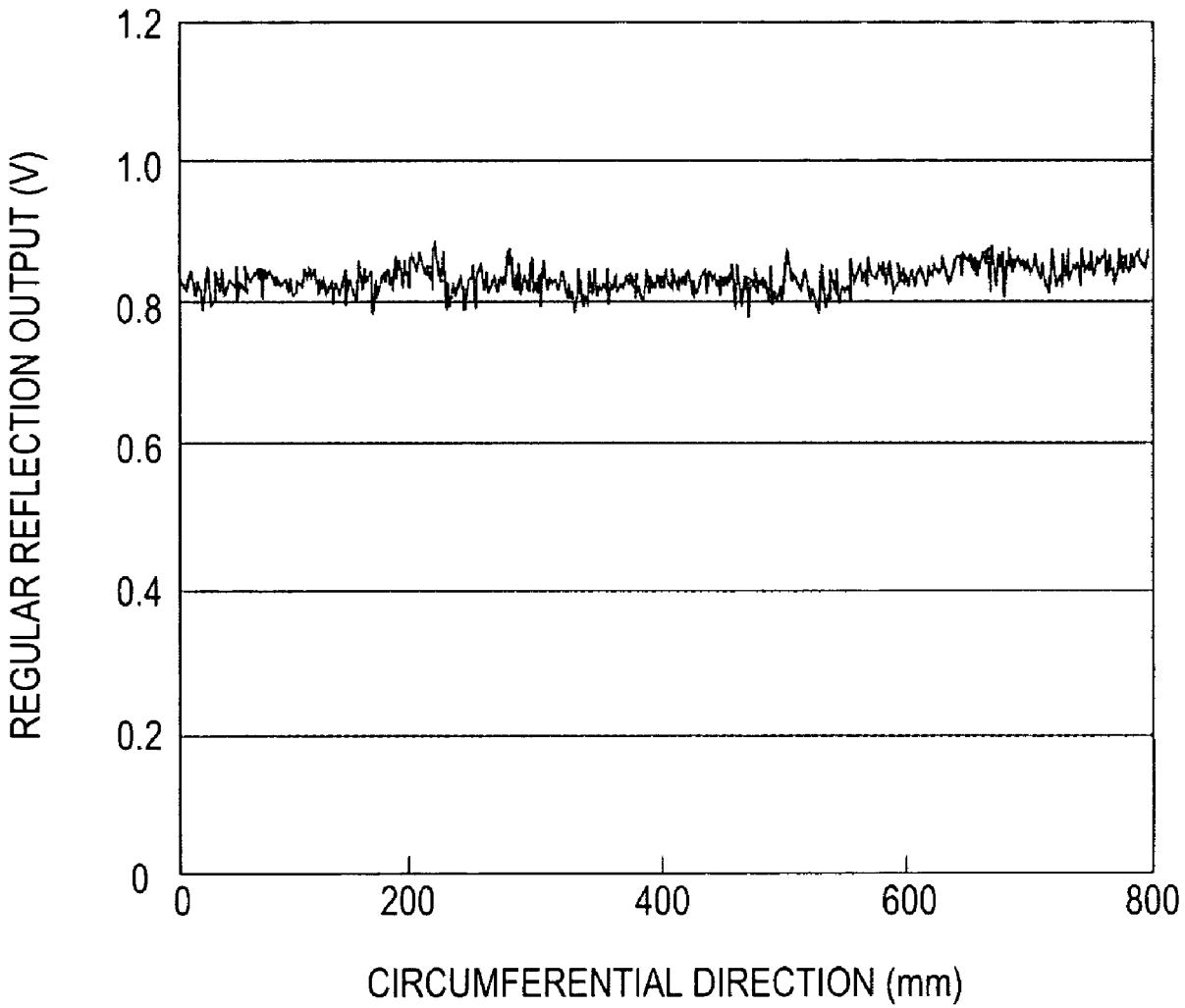
FIG. 8 is a graph showing the detection output from the density sensor for a belt in which a base layer is roughened according to the first embodiment.

FIG. 6 is a graph showing the regular reflection output from a density sensor with respect to a known type of belt having an unroughened base layer. FIGS. 7 and 8 are graphs showing the regular reflection outputs from the density sensor with respect to belts respectively having base layers roughened at two levels. In these graphs, the horizontal axis indicates the position on the belt in the circumferential direction expressed in millimeters (mm), and the vertical axis indicates the output (output voltage) from the density sensor. New belts were used, and were idly driven with no toner image thereon.

The above-described detection results show that surface roughening of the base layer reduces the baseline drift and ensures a stable regular reflection output.

Before roughening (FIG. 6), the output varied within the range of about 20% to 25% relative to the output center. In contrast, when roughening was performed so that the surface roughness Ra became about 0.07 to 0.09 μm (FIG. 7), the variation of the sensor output could be reduced to 10% to 12%, that is, reduced almost by half. When the surface roughness Ra was 0.10 to 0.15 μm (FIG. 8), the variation could be reduced to 10% or less.

In the first embodiment, the surface roughness Ra of the base layer is specified to prevent regular reflection of light at the interface between the surface layer and the base layer, and to prevent the light from interfering with light regularly reflected by the surface layer. This achieves stable detection.

Figure 10:
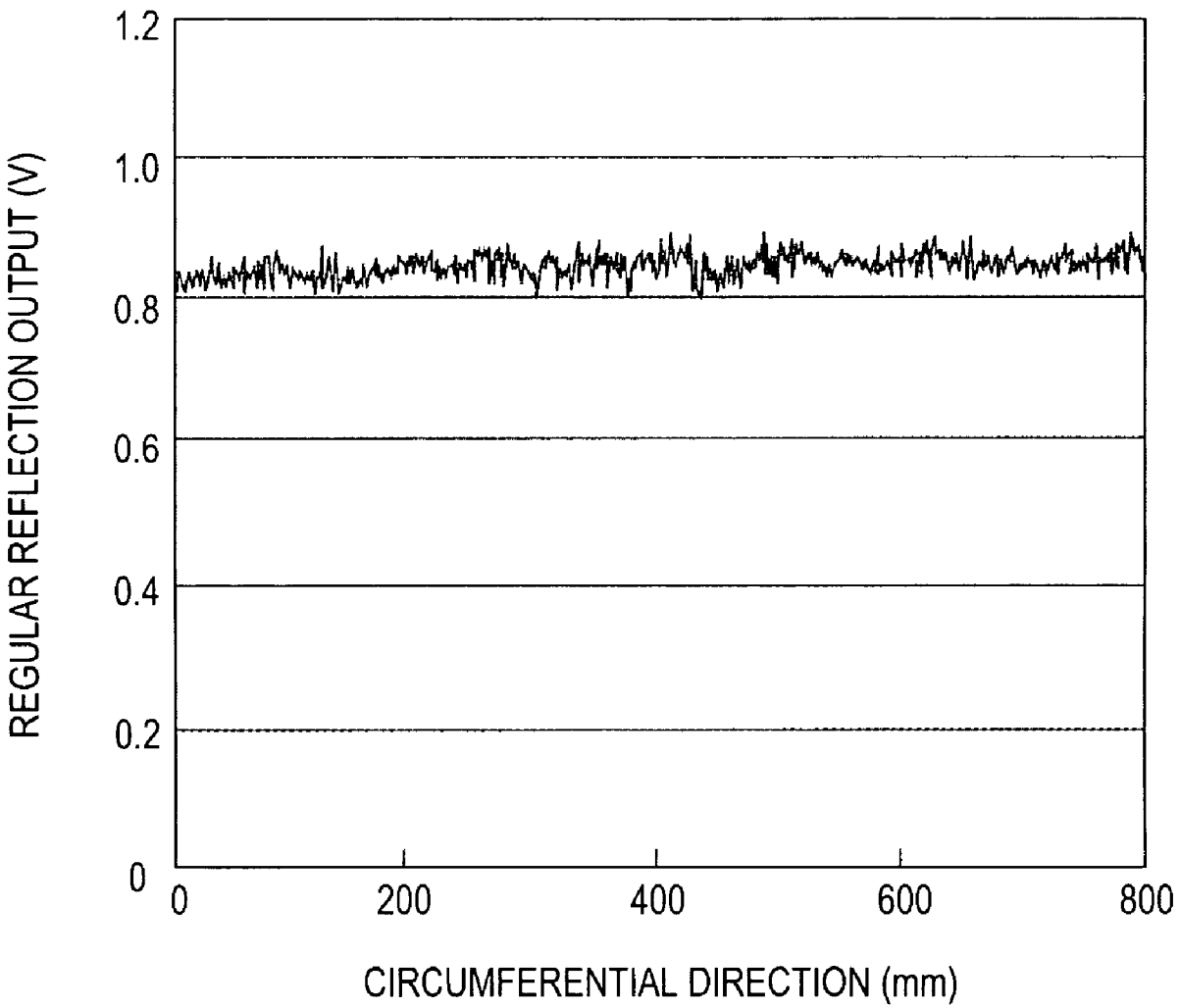
FIG. 10 is a graph showing the detection output from the density sensor for a two-layer belt which is not uniform in thickness and in which a base layer is roughened according to the first embodiment.

FIG. 10 shows the waveform of an output produced by the density sensor when a base layer in a belt of the same type as the known two-layer belt having the waveform shown in FIG. 9 (the thickness of a surface layer widely varies) is subjected to roughening. In this case, the surface roughness Ra of the base layer is 0.10 to 0.13 μm.

The waveform of the output from the density sensor widely varies because of the nonuniform thickness of the known two-layer belt. In contrast, as shown in FIG. 10, in the belt of the first embodiment, the waveform of the output from the density sensor almost does not vary, and a stable output can be produced, regardless of whether the thickness of the surface layer is uniform.

In this way, the surface roughness Ra of the base layer of the two-layer belt is set at 0.1 μm or more to avoid regular reflection at the base layer. Consequently, interference of reflected light between the base layer and the surface layer is prevented, density detection is constantly controlled with high precision, and good image formation is achieved.

Figure 1:
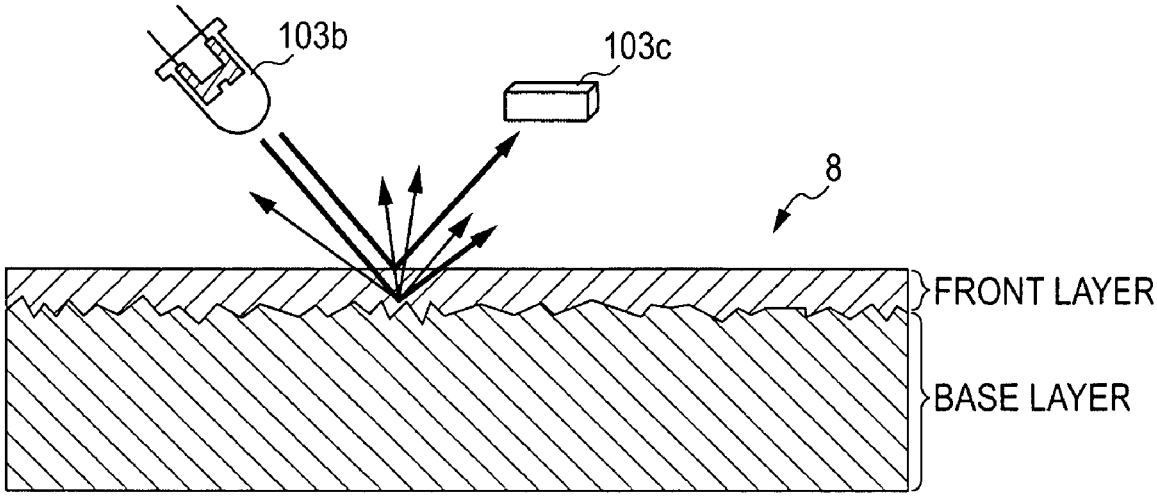
FIG. 1 is a conceptual view of a belt and a sensor according to a first embodiment of the present invention.
Figure 3:
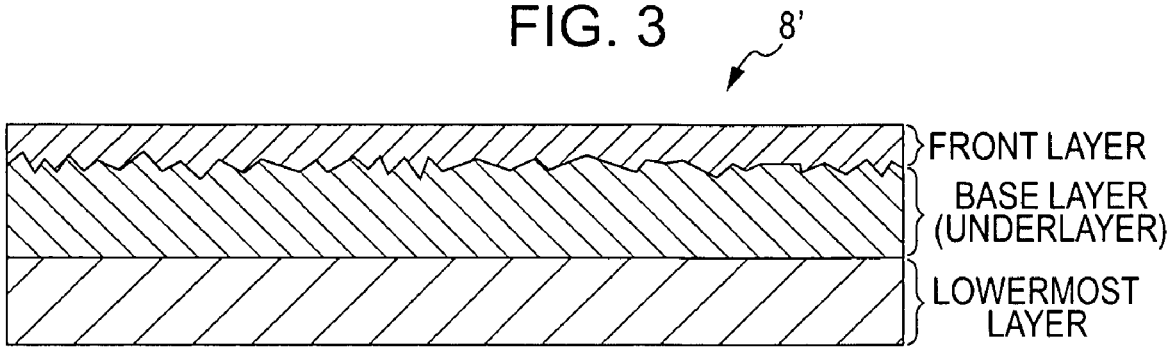
FIG. 3 is a conceptual view of a modification of the belt in the first embodiment.

While the ETB 8 has a two-layer structure shown in FIG. 1 in the first embodiment, a three-layer belt 8' shown in FIG. 3, which includes a lowermost layer, a base layer (underlayer), and a surface layer, and other multilayer belts may be adopted.

In the present invention, the surface layer has the property of transmitting light, and allows light reflection between the surface layer and the next layer (base layer, underlayer). For example, when a layer includes a plurality of chemically different layer sections, but all of the layer sections have a light transmitting property, the layer is regarded as one surface layer. Further, when two transparent layers are provided on the front side of a belt, the second layer doubles as a base layer and a part of a surface layer. Since light is sometimes reflected between the frontmost layer and the second layer, the frontmost layer and the second layer respectively correspond to the surface layer and the base layer in the first embodiment. Furthermore, light is sometimes reflected between the second layer and a lowermost layer provided thereunder. In this case, a combination of the frontmost layer and the second layer serves as the surface layer, and the lowermost layer serves as the base layer.

Resins used as the materials of the base layer, the surface layer, and the other layers are not particularly limited, and are, for example, polyethylene, polypropylene, polymethylpentene, polystyrene, polyamide, acrylic resin, fluorocarbon resin, polycarbonate, polysulfone, polyarylate, polyethylene terephthalate, polybutylene terephthalate, polyphenylene sulfide, polyether sulfone, polyether nitrile, thermoplastic polyimide, polyether ether ketone, thermotropic liquid crystal polymer, nonthermoplastic polyimide, aromatic polyamide, and thermoplastic elastomer.

The surface layer is preferably made of silicone hard coat resin, fluorocarbon resin, polycarbonate (PC), or polymethylmethacrylate (PMMA).

Second Embodiment

An intermediate transfer method according to a second embodiment of the present invention will now be described. The second embodiment is advantageous in that the type of recording materials has less influence on the transfer than in the method using the ETB in the first embodiment.

Configuration of Image Forming Apparatus

Figure 11:
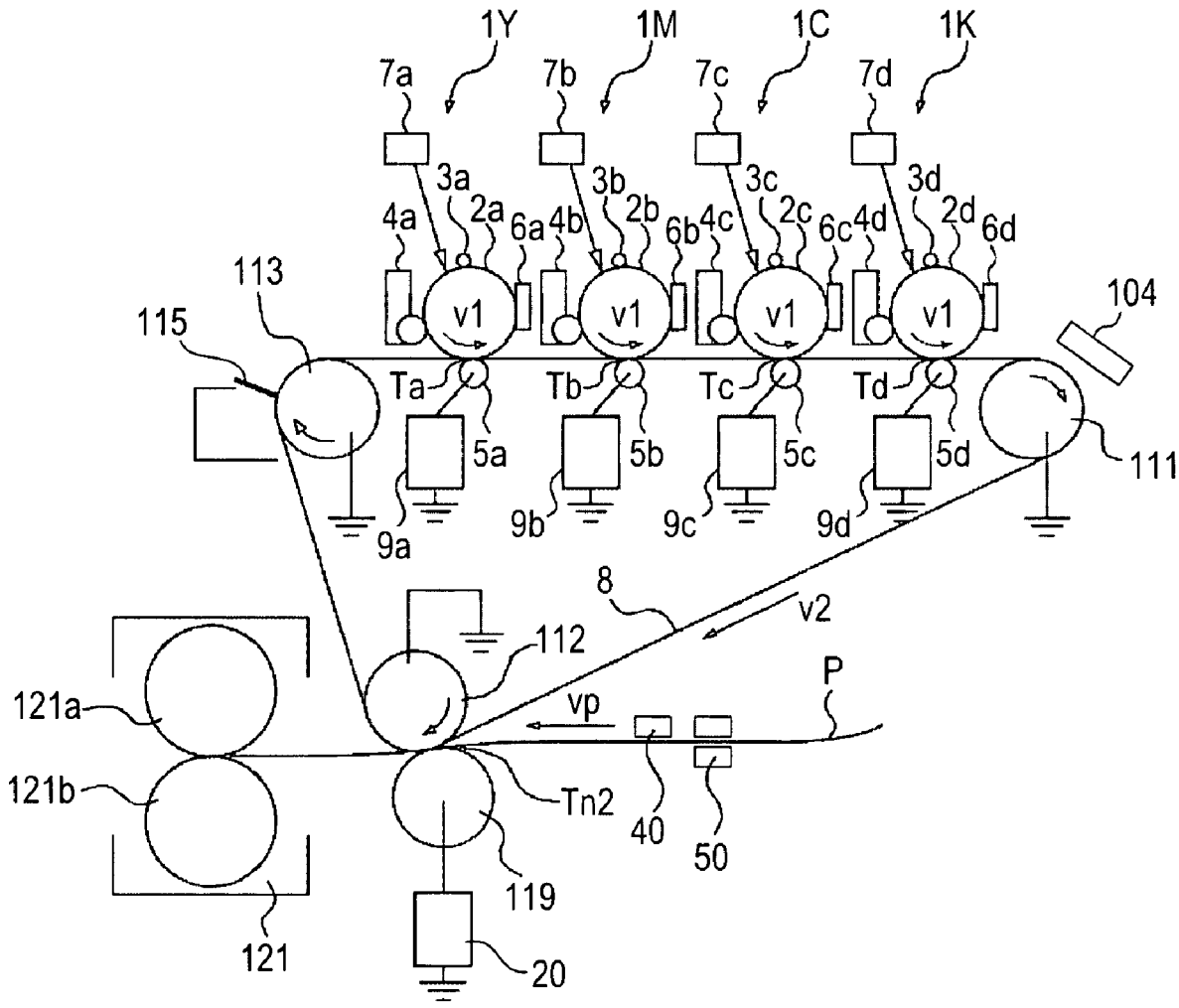
FIG. 11 is a schematic sectional view of an image forming apparatus according to a second embodiment of the present invention.

FIG. 11 is a schematic structural view of an image forming apparatus according to the second embodiment. The image forming apparatus includes four image forming stations 1Y, 1M, 1C, and 1K that respectively form a yellow image, a magenta image, a cyan image, and a black image. The image forming stations 1Y, 1M, 1C, and 1K are arranged in line at regular intervals.

The image forming stations 1Y, 1M, 1C, and 1K respectively include photoconductive drums 2*a*, 2*b*, 2*c*, and 2*d* serving as image bearing members. Charging rollers 3*a*, 3*b*, 3*c*, and 3*d*, developing devices 4*a*, 4*b*, 4*c*, and 4*d*, primary transfer rollers 5*a*, 5*b*, 5*c*, and 5*d*, drum cleaning devices 6*a*, 6*b*, 6*c*, and 6*d* are respectively disposed around the photoconductive drums 2*a*, 2*b*, 2*c*, and 2*d*. Exposure devices 7*a*, 7*b*, 7*c*, and 7*d* are respectively disposed above the charging rollers 3*a*, 3*b*, 3*c*, and 3*d* and the developing devices 4*a*, 4*b*, 4*c*, and 4*d*.

The photoconductive drums 2*a*, 2*b*, 2*c*, and 2*d* are negatively charged organic photoconductive (OPC) drums having an outer diameter of 30.0 mm. In each of the photoconductive drums 2*a*, 2*b*, 2*c*, and 2*d*, an OPC layer is provided on a drum base made of, for example, aluminum.

The charging rollers 3*a*, 3*b*, 3*c*, and 3*d* serving as contact charging means are respectively in contact with the photoconductive drums 2*a*, 2*b*, 2*c*, and 2*d* with a predetermined pressure.

The developing devices 4*a*, 4*b*, 4*c*, and 4*d* adopt a two-component developing method, and contain yellow toner, magenta toner, cyan toner, and black toner, respectively.

The primary transfer rollers 5*a*, 5*b*, 5*c*, and 5*d* serving as contact transfer means are in contact with the surfaces of the photoconductive drums 2*a*, 2*b*, 2*c*, and 2*d* with a predetermined pressure while an intermediate transfer belt 8 serving as an intermediate transfer member is disposed therebetween. The intermediate transfer belt 8 is tightly stretched by a driving roller 111, a secondary transfer opposing roller 112, and a driven roller 113. A tension load of 98 N is imposed on the driven roller 113 by a pressure means (not shown) so that the intermediate transfer belt 8 does not slip relative to the driving roller 111. The driving roller 111, the secondary transfer opposing roller 112, and the driven roller 113 are electrically grounded.

A secondary transfer roller 119 serving as another contact transfer means is in contact with the secondary transfer opposing roller 112 with a predetermined pressure in a secondary transfer section while the intermediate transfer belt 8 is disposed therebetween.

A fixing device 121 includes a fixing roller 121*a* and a pressure roller 121*b*, and is disposed on the left side of the secondary transfer roller 119 and the secondary transfer opposing roller 112.

A reflective optical recording-material sensor 40 and a transmissive optical recording-material sensor 50 are disposed at the positions through which a recording material P passes before it reaches the secondary transfer section in the image forming apparatus.

An image forming operation performed by the above-described image forming apparatus of the second embodiment will now be described. When an image-formation start signal is output, the photoconductive drums 2*a*, 2*b*, 2*c*, and 2*d* in the image forming stations 1Y, 1M, 1C, and 1K are rotated by a driving device (not shown) in the direction of the arrows in FIG. 11 (counterclockwise) at a predetermined moving velocity v1 of approximately 117 mm/s. The charging rollers 3*a*, 3*b*, 3*c*, and 3*d*, to which a charging bias has been applied from a charging-bias source (not shown), respectively and uniformly charge the surfaces of the photoconductive drums 2*a*, 2*b*, 2*c*, and 2*d* at a predetermined negative potential (approximately −650 V in the second embodiment). The exposure devices 7*a*, 7*b*, 7*c*, and 7*d* convert color-separated image signals input from a host computer (not shown) into optical signals. Laser light serving as the optical signals is scanned onto the charged photoconductive drums 2*a*, 2*b*, 2*c*, and 2*d* to form electrostatic latent images according to image information.

First, an electrostatic latent image formed on the photoconductive drum 2*a* is reverse-developed with yellow toner by the developing device 4*a* to which a negative developing bias is applied from a developing-bias source (not shown) so as to become a visual yellow toner image. In the second embodiment, the developing bias is obtained by superimposing an AC voltage component of 1.5 kVpp on a DC voltage component of −400V, and has a frequency of 3 kHz and a rectangular waveform.

The yellow toner image is then transferred onto the intermediate transfer belt 8 at a first primary transfer position Ta by the primary transfer roller 5*a* to which a positive primary transfer bias vt1 (controlled to be a fixed voltage of approximately +200 V in the second embodiment) is applied from a primary transfer-bias source 9*a*. In this case, the intermediate transfer belt 8 is being moved (rotated) by the rotation of the driving roller 111 at a predetermined moving velocity v2 of 120 mm/s in the direction of the arrow and in synchronization with the rotation of the photoconductive drums 2*a*, 2*b*, 2*c*, and 2*d*.

The portion of the intermediate transfer belt 8 on which the yellow toner image is transferred is moved to the image forming station 1M by the driving of the driving roller 111. In the image forming station 1M, a magenta toner image formed on the photoconductive drum 2*b* is similarly transferred onto the intermediate transfer belt 8 at a second primary transfer position Tb. The magenta toner image is superimposed on the yellow toner image on the intermediate transfer belt 8 by the primary transfer roller 5*b* to which a primary transfer bias vt1 is applied from a primary transfer bias source 9*b*.

Subsequently, cyan and black toner images are similarly transferred onto the yellow and magenta toner images superimposed on the intermediate transfer belt 8. The cyan and black toner images are respectively formed on the photoconductive drums 2*c* and 2*d* of the image forming stations 1C and 1K, and are transferred at third and fourth primary transfer positions Tc and Td. Transfer is performed by the primary transfer rollers 5*c* and 5*d* to which a primary transfer bias vt1 is applied from transfer bias sources 9*c* and 9*d*. Consequently, a full-color image is formed on the intermediate transfer belt 8.

In synchronization with the timing at which a leading end of the full-color toner image on the intermediate transfer belt 8 reaches a secondary transfer position Tn2 between the secondary transfer roller 119 and the secondary transfer opposing roller 112, a recording material P is conveyed to the secondary transfer position Tn2. Then, the full-color toner image is transferred onto the recording material P by the secondary transfer roller 119 to which a positive secondary transfer bias (+20 μA in this embodiment) is applied from a secondary transfer bias source 20 (secondary transfer).

A position sensor 104 is disposed opposed to the intermediate transfer belt 8. The position sensor 104 has a structure substantially similar to that of the density sensor 103 in the first embodiment. The position sensor 104 senses a toner image or a so-called toner patch formed on the intermediate transfer belt 8 in order to detect the timing at which a specific position on the intermediate transfer belt 8 passes thereat. Since the recording material P is conveyed to the secondary transfer position Tn2 according to the timing detected by the position sensor 104, the toner image on the intermediate transfer belt 8 can be secondarily transferred onto an appropriate position on the recording material P.

The recording material P is conveyed to the fixing device 121 after the full-color image is formed thereon, and is heated and pressed at a fixing nip between the fixing roller 121*a* and the pressure roller 121*b* in the fixing device 121. Through the above-described processes, the image forming operation is completed.

During the above-described primary transfer process, toner remaining on the photoconductive drums 2*a*, 2*b*, 2*c*, and 2*d* is removed and collected by the drum cleaning devices 6*a*, 6*b*, 6*c*, and 6*d*. Further, toner remaining on the surface of the intermediate transfer belt 8 after secondary transfer is removed and collected by a belt cleaning device 115.

In this image forming apparatus, the direction in which laser light is scanned refers to a main scanning direction, and the directions shown by the arrows in which the photoconductive drums 2*a*, 2*b*, 2*c*, and 2*d* , the intermediate transfer belt 8, and the recording material P move refer to sub-scanning directions.

Intermediate Transfer Belt

The intermediate transfer belt 8 serving as the image bearing member has the same structure as that of the ETB 8 which has been described in the first embodiment. That is, the intermediate transfer belt 8 is a two-layer belt including a PVDF base layer having a resistance adjusted to $1\times10^{6}$ to $1\times10^{11}$ Ω.cm and a surface layer made of acrylic resin. Ribs stuck on both back side edges of the intermediate transfer belt 8 prevent meandering and offset of the belt.

In the image forming apparatus using the intermediate transfer belt, it was also verified that, when the base layer of the belt had a surface roughness Ra of 0.1 μm or more, precise density detection was possible and a good full-color image was obtained.

In the intermediate transfer belt (ITB) of the second embodiment, reflection of light at the interface between the surface layer and the base layer is also prevented by setting the surface roughness Ra of the base layer at 0.1 μm or more. Moreover, a stable output from the position sensor 104 can be obtained, regardless of the thickness of the surface layer. This permits accurate positioning for secondary transfer.

Third Embodiment

A basic configuration of a third embodiment of the present invention is similar to that of the above-described first embodiment.

In the third embodiment, a base layer is made of polyethylene terephthalate (PET) resin having a resistance adjusted to $1\times10^{6}$ to $1\times10^{11}$ Ω.cm. A desired surface roughness Ra of the base layer is obtained by dispersing filler, such as glass fine particles, silica, PMMA, or boron nitride, as roughening particles in the base layer. A front coat layer is made of resin, such as acrylic resin, silicone hard coat resin, fluorocarbon resin, PC, or PMMA, on the surface of the base layer, in a manner similar to that employed in the first and second embodiments.

The surface roughness Ra of the base layer is set to be 0.11 to 0.15 μm by adjusting the mean diameter and mixing amount (mixing ratio) of the dispersed particles. A front coat layer having a thickness of 2.0 μm is provided on the base layer to form a two-layer belt. It was verified that the two-layer belt of the third embodiment also allowed the density sensor to produce a stable output, similarly to the first and second embodiments.

In this way, the surface roughness Ra of the base layer is set at 0.1 μm or more by dispersing the roughening particles. This ensures a stable output from the density sensor, regardless of the thickness of the surface layer of the belt, avoids variations in reflection output, and enables precise density detection control.

The third embodiment is also applicable to the ITB described in the second embodiment.

Fourth Embodiment

A basic configuration of a fourth embodiment of the present invention is similar to that in the above first embodiment.

In the fourth embodiment, the surface of a base layer is roughened by blasting using spherical particles or particles having no regular form. Blasting is a method for polishing the surface of an object, for example, by blowing polishing particles onto the object.

The surface roughness Ra of the base layer is adjusted to be within the range of 1.0 to 1.5 μm by blasting. A front coat layer having a thickness of approximately 1 μm to 2 μm is provided on the base layer to form a two-layer belt. Further, the base layer is not roughened over the entirety of the belt, but is roughened only in a part of the belt in order to obtain a desired surface roughness. The roughened part corresponds to a region of the belt opposing the density sensor 103. For example, when the density sensor 103 opposes one side of the belt, only that one side is roughened. This is because it is satisfactory, in order to increase density detection accuracy, as long as at least the region opposing the density sensor 103 is roughened. It was verified that a stable output could be produced from the density sensor when the base layer was subjected to blasting, similarly to the first and second embodiments.

By thus setting the surface roughness Ra of the base layer in the desired region to be 0.1 μm or more by blasting, a stable output can be obtained, regardless of the thickness of the surface layer of the belt, and precise density detection is possible. As a result, the image forming apparatus can form good full-color images.

The surface of the base layer of the two-layer belt is roughened by blasting in the fourth embodiment. When the base layer is formed by using an inner mold, the roughness of an inner surface of the inner mold is adjusted so that the surface roughness Ra of the base layer is 0.1 μm or more. In this case, similar advantages can be provided.

In the fourth embodiment, the ITB that has been described in the second embodiment is also applicable.

Fifth Embodiment

A basic configuration of a fifth embodiment of the present invention is similar to that employed in the above-described first embodiment.

In the fifth embodiment, a base layer of a belt is shaped like a tube by winding a thermoplastic film around a cylindrical member, placing both ends of the film on one on another, fitting a tubular member (outer mold) on the wound film, and heating the film to join the ends.

The surface roughness Ra of the base layer is set to be 0.1 μm or more, preferably, within the range of 0.1 to 0.15 μm by adjusting the surface of an inner wall of the tubular member (outer mold). A front coat layer having a thickness of approximately 1 to 2 μm is formed on the base layer to form a two-layer belt. It is verified that this belt allowed a stable output to be produced from the density sensor, in a manner similar to that in the first to fourth embodiments.

In this way, the surface roughness Ra of the base layer is set to be 0.1 μm or more by adjusting the roughness of the inner surface of the tubular member (outer mold). Consequently, a stable output can be produced from the density sensor, regardless of the thickness of the surface layer of the belt, density detection can be accurately performed, and good full-color images can be obtained.

In the fifth embodiment, the ITB that has been described in the second embodiment is also applicable.

The image forming apparatuses in the above-described embodiments use a two-layer belt as the ETB or the ITB. The present invention is also applicable to other types of belts used in other manners, and is not applied only to prevent interference by reflected light from the interface between the surface layer and the base layer from adversely affecting the sensor. Further, the present invention is applicable not only to a printer, but also to other image forming apparatuses, such as copying machines and facsimile apparatuses, or to multifunctional apparatuses having these functions in combination. In this case, similar advantages can be achieved.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-375465 filed Dec. 27, 2004, which is hereby incorporated by reference herein in its entirety.

What is claimed is:

1. An image forming apparatus comprising:

an image bearing member for bearing a toner image;

a belt onto which the toner image is transferred from the image bearing member;

a light emitting member for emitting light onto the toner image formed on the belt;

a light receiving member for receiving reflected light from the toner image formed on the belt; and an image forming controller for changing image forming conditions based on a result detected by the light receiving member, wherein the belt includes a base layer and a surface layer provided on the base layer, the surface layer transmits the light emitted from the light emitting member, and a surface roughness Ra of a surface side of the base layer facing the surface layer is a range of 0.1 μm to 1.5 μm, inclusive.

2. The image forming apparatus according to claim 1, wherein the surface roughness Ra of the surface side of the base layer provided on a portion of the surface of the belt is 0.1 μm or more, and the portion reflects the light emitted from the light emitting member.

3. The image forming apparatus according to claim 1, wherein the surface layer is made of acrylic resin.

4. The image forming apparatus according to claim 1, wherein a profile of the surface side of the base layer is formed by mixing particles in the base layer.

5. The image forming apparatus according to claim 1, wherein transmittance of the surface layer is 30% or more.

6. The image forming apparatus according to claim 1, wherein the belt transfers a toner image provided thereon onto a recording material.

7. The image forming apparatus according to claim 1, wherein the belt can bear a recording material, and can transfer a toner image from the first image bearing member onto the recording material.

8. An image forming apparatus comprising:

a belt including a base layer and a surface layer provided on the base layer;

a light emitting member for emitting light onto a toner image formed on the belt;

a light receiving member for receiving reflected light from the toner image formed on the belt; and an image forming controller for changing image forming conditions based on a result detected by the light receiving member, wherein the surface layer transmits the light emitted from the light emitting member, and the belt reflects the light emitted from the light emitting member at a surface side of the belt and a surface side of the base layer facing the surface layer, and wherein a ratio of an intensity of an irregularly reflected light component, of the reflected light from the belt, to an intensity of a regularly reflected light component is higher at the surface side of the base layer than at the surface side of the surface layer.

9. The image forming apparatus according to claim 8, wherein the ratio of the intensity of the irregularly reflected light component, of the reflected light from the belt, to the intensity of the regularly reflected light component in a part of the belt is higher at the surface side of the base layer than at the surface side of the surface layer, and the part reflects the light from the light emitting member.

10. The image forming apparatus according to claim 8, wherein the surface layer is made of acrylic resin.

11. The image forming apparatus according to claim 8, wherein a profile of the surface side of the base layer is formed by mixing particles in the base layer.

12. The image forming apparatus according to claim 8, wherein a transmittance of the surface layer is 30% or more.

13. A belt applicable to an image forming apparatus for forming a toner image on the belt, detecting a reflected light from the toner image by a light receiving member, and changing image-forming conditions based on a result detected by the light receiving member, the belt comprising:

a base layer; and a surface layer provided on the base layer, wherein the surface layer transmits light, and wherein a surface roughness Ra of a surface side of the base layer facing the surface layer is a range of 0.1 μm to 1.5 μm, inclusive.

14. The belt according to claim 13, wherein the surface layer is made of acrylic resin.

15. The belt according to claim 13, wherein a profile of the surface side of the base layer is formed by mixing particles in the base layer.

16. The belt according to claim 13, wherein a transmittance of the surface layer is 30% or more.

17. A belt applicable to an image forming apparatus for forming a toner image on the belt, detecting a reflected light from the toner image by a light receiving member, and changing image-forming conditions based on a result detected by the light receiving member, the belt comprising:

a base layer; and a surface layer provided on the base layer, wherein the surface layer transmits light so that the light is reflected by a surface side of the surface layer provided on a surface side of the belt and by a surface side of the base layer facing the surface layer, and wherein a ratio of an intensity of an irregularly reflected light component, of light reflected by the belt, to an intensity of a regularly reflected light component is higher at the surface side of the base layer than at the surface side of the surface layer.

18. The belt according to claim 17, wherein the surface layer is made of acrylic resin.

19. The belt according to claim 17, wherein a profile of the surface side of the base layer is formed by mixing particles in the base layer.

20. The belt according to claim 17, wherein a transmittance of the surface layer is 30% or more.

* * * * *